US011518654B2

(12) United States Patent
Talonen et al.

(10) Patent No.: US 11,518,654 B2
(45) Date of Patent: Dec. 6, 2022

(54) COMBINED ELEVATOR VIBRATION ISOLATION AND LOAD MEASUREMENT ELEMENT

(71) Applicant: KONE Corporation, Helsinki (FI)

(72) Inventors: Tapani Talonen, Helsinki (FI); Tapio Siironen, Helsinki (FI); Henri Wenlin, Helsinki (FI); Ville Myyryläinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 349 days.

(21) Appl. No.: 16/783,307

(22) Filed: Feb. 6, 2020

(65) Prior Publication Data

US 2020/0283269 A1 Sep. 10, 2020

(30) Foreign Application Priority Data

Mar. 5, 2019 (EP) ..... 19160766

(51) Int. Cl.

| | |
|---|---|
| ***B66B 11/02*** | (2006.01) |
| ***B66B 1/34*** | (2006.01) |
| ***B66B 5/00*** | (2006.01) |
| ***B66B 7/04*** | (2006.01) |
| ***B66B 7/06*** | (2006.01) |

(52) U.S. Cl.

CPC ..... *B66B 11/0273* (2013.01); *B66B 1/3484* (2013.01); *B66B 5/0018* (2013.01); *B66B 7/048* (2013.01); *B66B 7/06* (2013.01)

(58) Field of Classification Search

CPC . B66B 1/3484; B66B 11/0273; B66B 5/0018; B66B 7/048; B66B 7/06

See application file for complete search history.

(56) References Cited

U.S. PATENT DOCUMENTS 4,793,442 A * 12/1988 Heckler ..... B66B 1/3484 187/292
5,306,879 A * 4/1994 Pearson ..... G01G 19/18 187/401
6,305,503 B1 * 10/2001 Suzuki ..... B66B 1/3476 187/393

(Continued)

FOREIGN PATENT DOCUMENTS

CN 110255332 A * 9/2019 ..... B66B 1/3484
EP 0 983 957 A2 3/2000

(Continued)

OTHER PUBLICATIONS

Extended European Search Report, issued in Priority Application No. 19160766.2, dated Sep. 26, 2019.

*Primary Examiner* — Diem M Tran

(74) *Attorney, Agent, or Firm* — Birch, Stewart, Kolasch & Birch, LLP

(57) ABSTRACT

An element includes a vibration isolation pad with two opposite substantially planar surfaces, an elastic material layer being permanently attached to a first of the two substantially planar surfaces of the vibration isolation pad, a load sensor arrangement integrated into the combined elevator vibration isolation and load measurement element. A load acting on the combined elevator vibration isolation and load measurement element can be measured with the load sensor arrangement as a function of the compression of the elastic material layer.

20 Claims, 6 Drawing Sheets

(56) References Cited

U.S. PATENT DOCUMENTS

Figure 1:
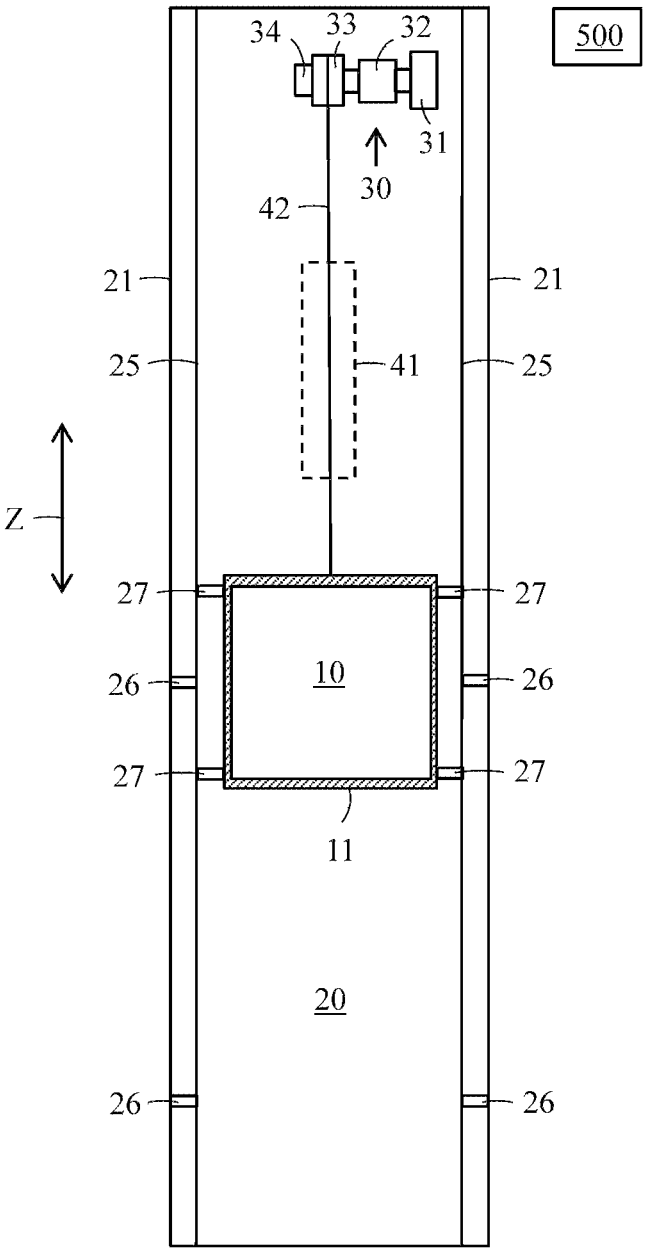

| | | | | |
|---|---|---|---|---|
| 7,926,622 | B2 * | 4/2011 | Henneau | B66B 5/00 187/393 |
| 9,056,747 | B2 * | 6/2015 | Brugger | G01L 1/22 |
| 2002/0070081 | A1 | 6/2002 | Bledsoe et al. | |
| 2016/0002004 | A1 * | 1/2016 | Tan | B66B 1/3476 248/560 |

FOREIGN PATENT DOCUMENTS

| | | | | |
|---|---|---|---|---|
| EP | 0 983 957 | A3 | 1/2002 | |
| JP | 59-124679 | A | 7/1984 | |
| JP | 2000255938 | A * | 9/2000 | B66B 7/08 |
| JP | 2018-144919 | A | 9/2018 | |

* cited by examiner

COMBINED ELEVATOR VIBRATION ISOLATION AND LOAD MEASUREMENT ELEMENT

FIELD

The invention relates to a combined elevator vibration isolation and load measurement element.

BACKGROUND

An elevator may comprise a car, a shaft, hoisting machinery, ropes, and a counterweight. A separate or an integrated car frame may surround the car.

The hoisting machinery may be positioned in the shaft. The hoisting machinery may comprise a drive, an electric motor, a traction sheave, and a machinery brake. The hoisting machinery may move the car upwards and downwards in the shaft. The machinery brake may stop the rotation of the traction sheave and thereby the movement of the elevator car.

The car frame may be connected by the ropes via the traction sheave to the counterweight. The car frame may further be supported with gliding means at guide rails extending in the vertical direction in the shaft. The guide rails may be attached with fastening brackets to the side wall structures in the shaft. The gliding means keep the car in position in the horizontal plane when the car moves upwards and downwards in the shaft. The counterweight may be supported in a corresponding way on guide rails that are attached to the wall structure of the shaft.

The car may transport people and/or goods between the landings in the building. The shaft may be formed so that the wall structure is formed of solid walls or so that the wall structure is formed of an open steel structure.

The elevator may be controlled by a controller.

The hoisting machinery may be supported on the machinery bed via a vibration isolation pad.

Strain gauge load sensors may be used to measure forces from the hoisting machinery to the machinery bed.

SUMMARY

An object of the present invention is to provide a novel combined elevator vibration isolating and load measurement element.

The combined elevator vibration isolation and load measurement element is defined in claim 1.

The combined elevator vibration isolation and load measurement element comprises a vibration isolation pad with two opposite substantially planar surfaces, an elastic material layer being permanently attached to a first of the two substantially planar surfaces of the vibration isolation pad, a load sensor arrangement integrated into the combined elevator vibration isolation and load measurement element, whereby a load acting on to the combined elevator vibration isolation and load measurement element can be measured with the load sensor arrangement as a function of the compression of the elastic material layer.

The combined elevator vibration isolation and load measurement element forms a simple and compact isolation element with an integrated load sensor arrangement.

The combined elevator vibration isolation and load measurement element is easy to install into variable places in the elevator.

The combined elevator vibration isolation and load measurement element is easy to keep in stock and to supply to a construction site.

The combined elevator vibration isolation and load measurement element can also be used as a spare part.

The combined elevator vibration isolation and load measurement element makes it possible also to measure tilting of the part being supported on the combined elevator vibration isolation and load measurement element. This is due to the fact that several sensor elements may be provided in the combined elevator vibration isolation and load measurement element.

An electrically conductive material means in this application a material of which the resistivity (specific electric resistivity) is less than 1 Ωm at the temperature of 20 degrees Celsius. An electrically non-conductive material means in this application a material of which the resistivity (specific electric resistivity) is more than 100 Ωm at the temperature of 20 degrees Celsius.

DRAWINGS

Figure 2:
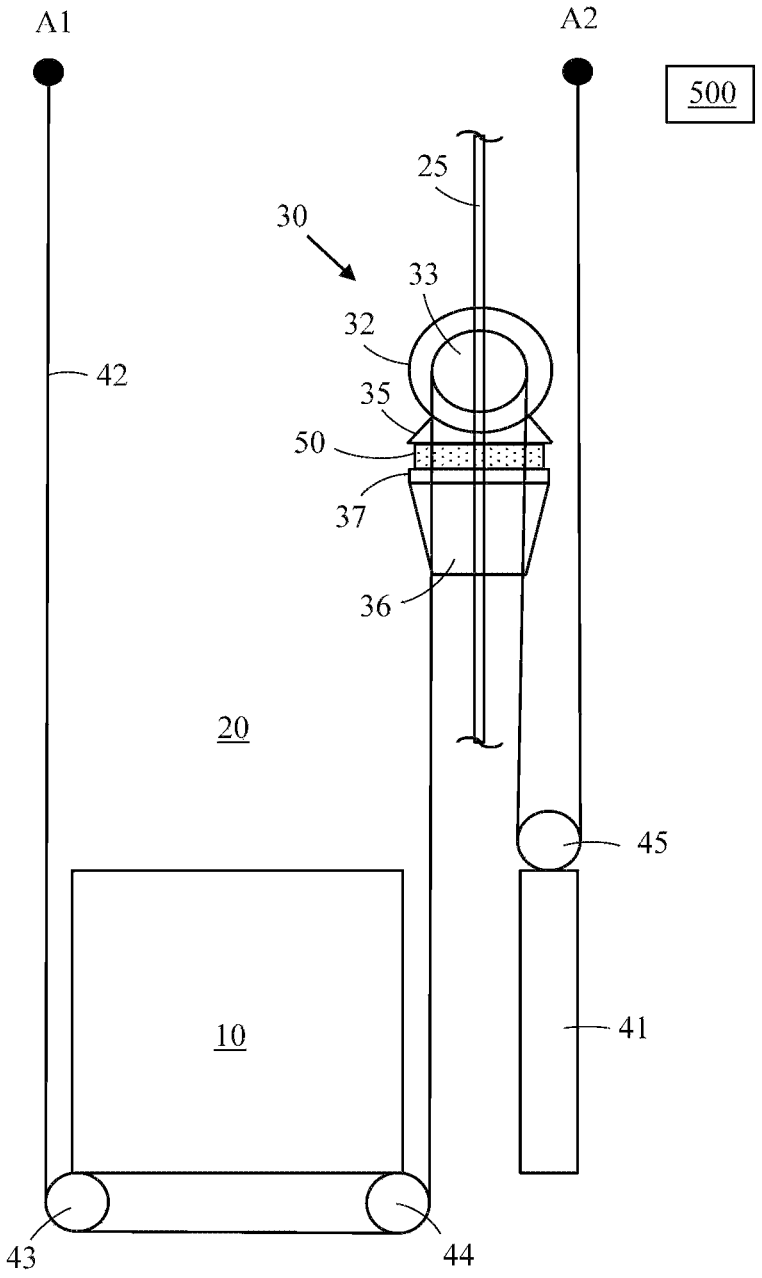
Figure 3:
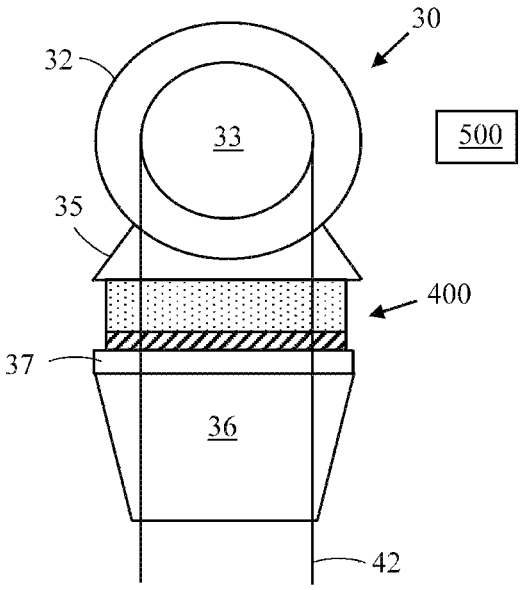
Figure 4:
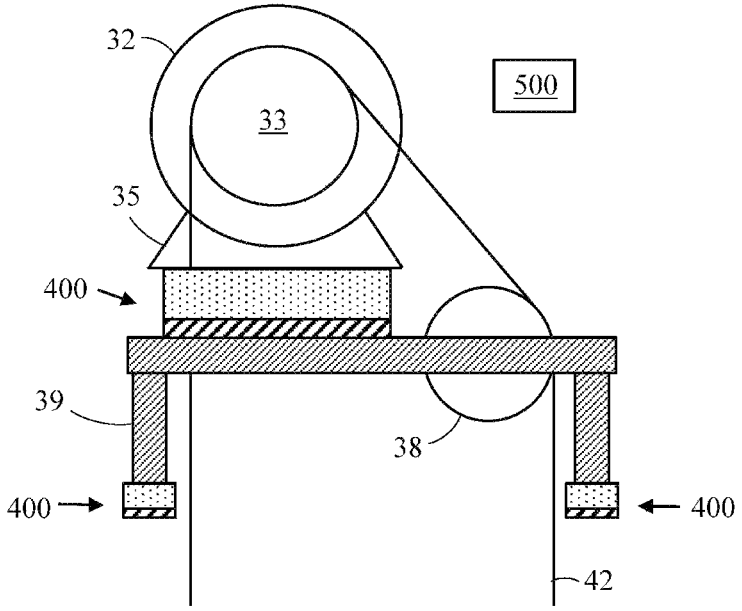
Figure 5:
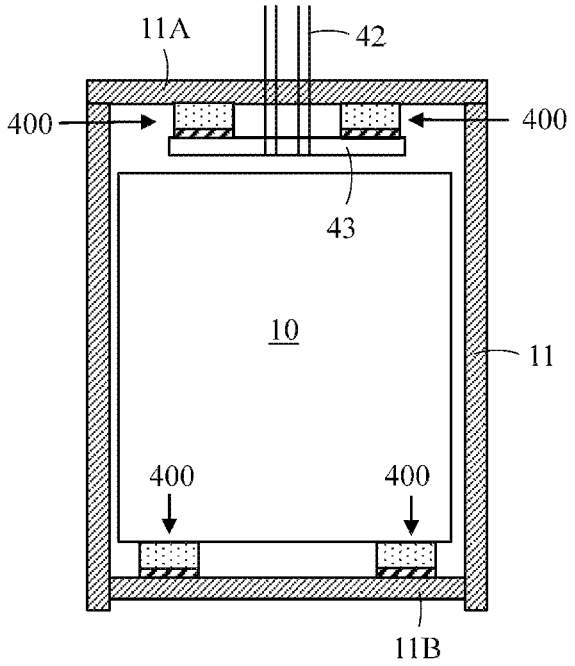
Figure 6:
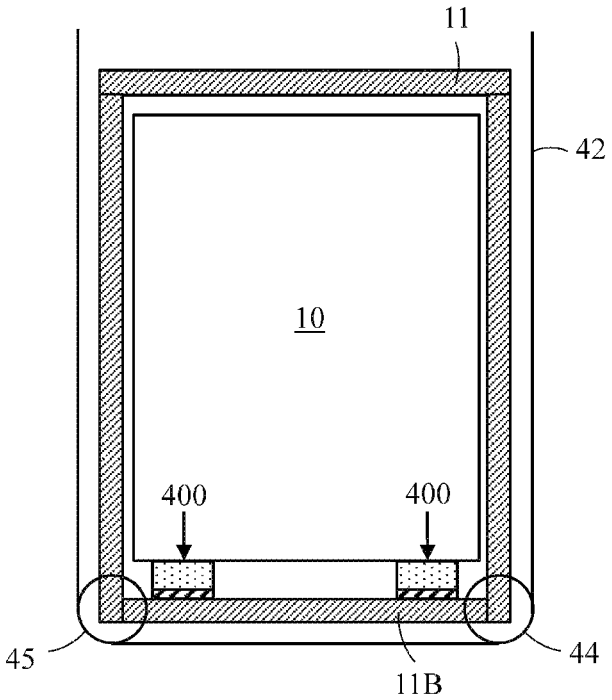
Figure 7:
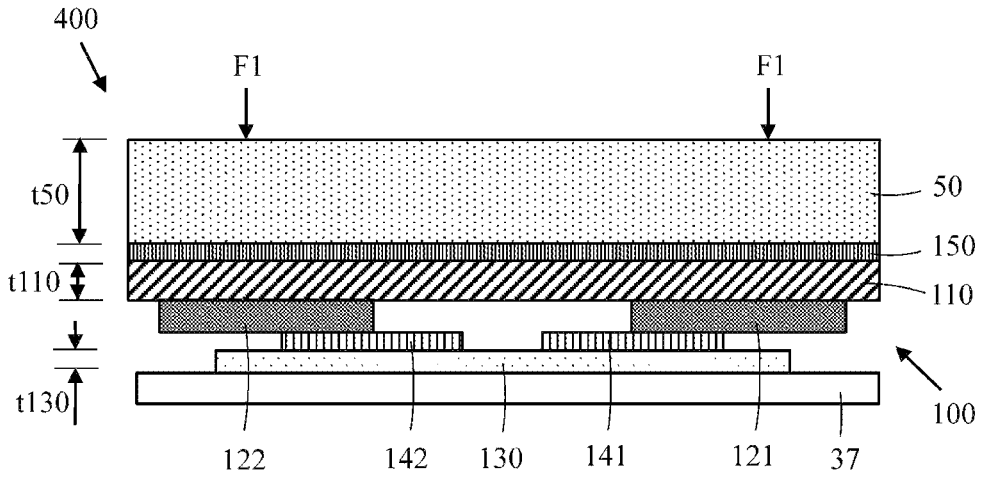
Figure 8:
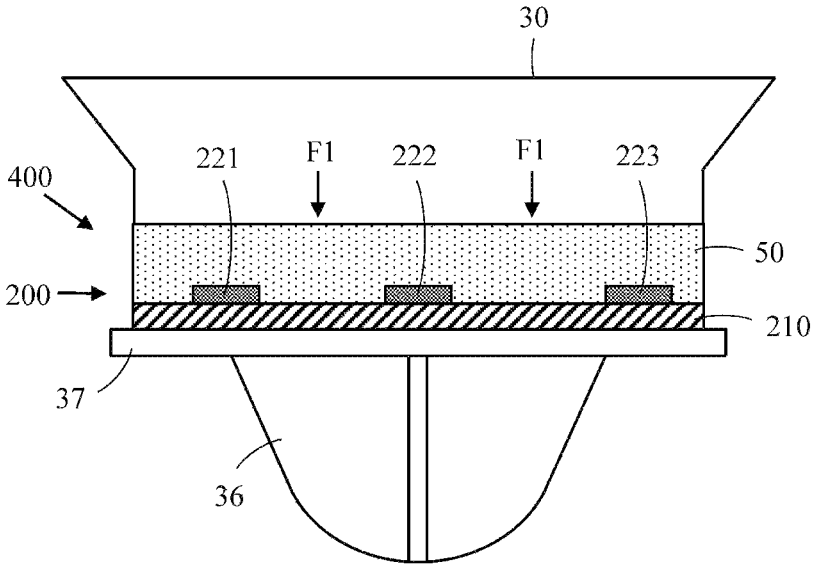
Figure 9:
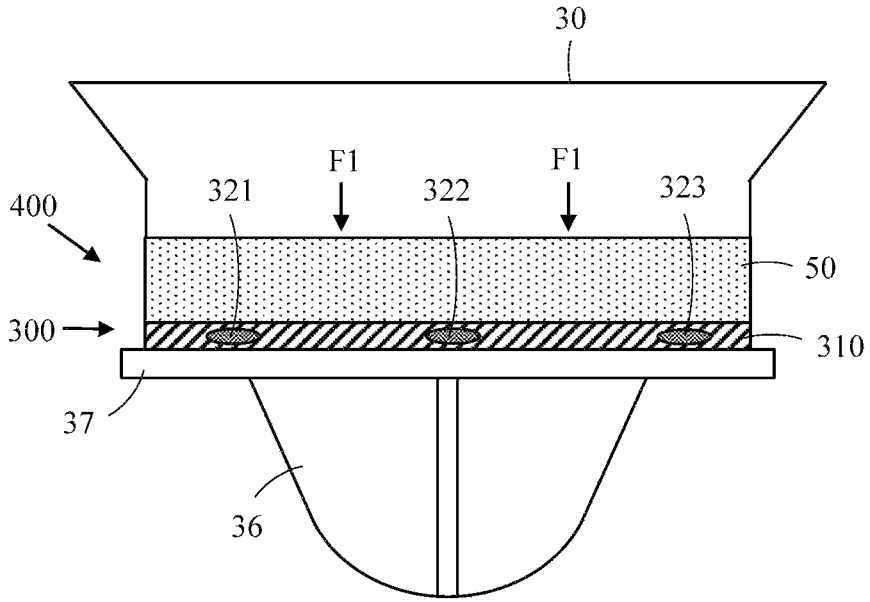

The invention will in the following be described in greater detail by means of preferred embodiments with reference to the attached drawings, in which FIG. 1 shows a side view of a first elevator, FIG. 2 shows a side view of a second elevator, FIG. 3 shows a side view of a first support arrangement of the hoisting machinery in an elevator, FIG. 4 shows a side view of a second support arrangement of the hoisting machinery in an elevator, FIG. 5 shows a side view of a first support arrangement of the car in an elevator, FIG. 6 shows a side view of a second support arrangement of the car in an elevator, FIG. 7 shows a side view of a first combined elevator vibration isolation and load measurement element, FIG. 8 shows a side view of a second combined elevator vibration isolation and load measurement element, FIG. 9 shows a side view of a third combined elevator vibration isolation and load measurement element.

DETAILED DESCRIPTION

FIG. 1 shows a side view of a first elevator.

The elevator may comprise a car 10, an elevator shaft 20, hoisting machinery 30, hoisting ropes 42, and a counterweight 41. A separate or an integrated car frame 11 may surround the car 10.

The hoisting machinery 30 may be positioned in the shaft 20. The hoisting machinery may comprise a drive 31, an electric motor 32, a traction sheave 33, and a machinery brake 34. The hoisting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with gliding means 27 at guide rails 25 extending in the vertical direction in the shaft 20. The gliding means 27 may comprise rolls rolling on the guide rails 25 or gliding shoes gliding on the guide rails 25 when the car 10 is moving upwards and downwards in the elevator shaft 20. The guide rails 25 may be attached with fastening brackets 26 to the side wall structures 21 in the elevator shaft 20. The gliding means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The car 10 may transport people and/or goods between the landings in the building. The elevator shaft 20 may be formed so that the wall structure 21 is formed of solid walls or so that the wall structure 21 is formed of an open steel structure.

The roping ratio is 1:1 in this first elevator. When the electric motor 32 lifts or lowers the car 10 in this first elevator by X meters, then X meters of lifting rope 42 passes over the traction sheave 32.

The elevator may be controlled by a controller 500.

FIG. 2 shows a side view of a second elevator.

This second elevator differs from the first elevator shown in FIG. 1 in the roping ratio. The roping ratio in this second elevator is 2:1 compared to the roping ratio 1:1 in the first elevator shown in FIG. 1. When the electric motor 32 lifts or lowers the car 10 in this second elevator by X meters, then 2× meters of lifting rope 42 passes over the traction sheave 32.

Both ends of the hoisting rope 42 are fixed in fixing points A1, A2 to the shaft 20 in an upper end portion of the shaft 20. The hoisting rope 42 passes from a first fixing point A1 vertically downwards in the shaft 20 towards the lower end of the car 10. The hoisting rope 42 is then turned on a first deflection roll 43 positioned below the car 10 into a horizontal direction. The hoisting rope 42 passes then in the horizontal direction to a second deflection roll 44 positioned below the car 10 at an opposite side of the car 10 in relation to the first deflection roll 43. The car 10 is supported on the first deflection roll 43 and on the second deflection roll 44. The hoisting rope 42 passes after the second deflection roll 44 again vertically upwards in the shaft 20 towards the traction sheave 33. The hoisting rope 42 is then again turned on the traction sheave 33 into a vertically downwards directed direction in the shaft 20 towards a third deflection roll 45. The counterweight 41 is supported on the third deflection roll 45. The hoisting rope 42 passes then after the third deflection roll 45 again vertically upwards in the shaft 20 to the second fixing point A2. Rotation of the traction sheave 33 in a clockwise direction moves the car 10 upwards, whereby the counterweight 41 moves downwards and vice a versa. The friction between the hoisting rope 42 and the traction sheave 33 eliminates slipping of the hoisting rope 42 on the traction sheave 33 in normal operational conditions.

The electric motor 32 in the hoisting machinery 30 may comprise a motor frame 35 for supporting the hoisting machinery 30 at a motor bed frame 36. A vibration isolation pad 50 and a load transfer plate 37 may be positioned between the motor frame 35 and the motor bed 36. The motor bed 36 may be supported on a guide rail 25 in the shaft 20. The hoisting machinery 30 could be supported on the guide rail 25 in any height position along the guide rail 25. The traction sheave 33 and the electric motor 32 could also be separated. The traction sheave 33 could be supported on the guide rail 25 in the shaft 20 and the electric motor 32 could be positioned e.g. at the bottom of the pit in the shaft 20. A power transmission would thus be needed between the traction sheave 33 and the electric motor 32.

The elevator may be controlled by a controller 500.

FIG. 3 shows a side view of a first support arrangement of the hoisting machinery in an elevator.

The hoisting machinery 30, of which only the electric motor 32 and the traction sheave 33 is shown in the figure, is supported via a motor frame 35 on a motor bed 36. The hoisting ropes 42 pass over the traction sheave 33.

A combined elevator vibration isolation and load measurement element 400 may be positioned between the motor frame 35 and the load transfer plate 37 positioned on the motor bed 36.

The combined elevator vibration isolation and load measurement element 400 may be formed as a combination of a vibration isolation pad, an elastic material layer and an integrated load sensor arrangement.

The isolation pad eliminates at least to some extent the transfer of vibrations from the hoisting machinery 30 to the motor bed 36. The load sensor arrangement measures the forces acting on the motor bed 36.

The elevator may be controlled by a controller 500.

FIG. 4 shows a side view of a second support arrangement of the hoisting machinery in an elevator.

The hoisting machinery 30, of which only the electric motor 32 and the traction sheave 33 is shown in the figure, is supported via a motor frame 35 on a motor bed 39. The motor bed 39 may be supported via legs on the floor in a machine room. The hoisting ropes 42 pass over the traction sheave 33 and over a deflection sheave 38.

A combined elevator vibration isolation and load measurement element 400 may be positioned between the motor frame 35 and the motor bed 39 or between each foot of the motor bed 39 and the floor.

The combined elevator vibration isolation and load measurement element 400 may be formed as a combination of a vibration isolation pad, an elastic material layer and an integrated load sensor arrangement.

The isolation pad eliminates at least to some extent the transfer of vibrations from the hoisting machinery 30 to the motor bed 36. The load sensor arrangement measures the forces acting on the motor bed 39 or on the floor.

The elevator may be controlled by a controller 500.

FIG. 5 shows a side view of a first support arrangement of the car in an elevator.

The frame 11 of the car 10 is supported by the hoisting ropes 42. The hoisting ropes 42 are attached to a horizontal support bar 43. The horizontal support bar 43 is attached to the upper horizontal bar 11A of the frame 11. The car 10 is supported on the lower horizontal bar 11B of the frame 11.

A combined elevator vibration isolation and load measurement element 400 may be positioned between the horizontal support bar 43 and the upper horizontal bar 11A of the frame 11 or between the bottom of the car 10 and the lower horizontal support bar 11B of the frame 11.

The horizontal support bar 43 may be supported via a combined elevator vibration isolation and load measurement element 400 positioned at each end of the horizontal support bar 43 to the upper horizontal bar 11A of the frame 11.

The bottom of the car 10 may be supported via e.g. four combined elevator vibration isolation and load measurement elements 400 on the lower horizontal bar 11B of the frame 11. The combined elevator vibration isolation and load measurement elements 400 may be positioned in the corners of the bottom of the car 10.

The combined elevator vibration isolation and load measurement element 400 may be formed as a combination of a vibration isolation pad, an elastic material layer and an integrated load sensor arrangement.

The isolation pad eliminates at least to some extent the transfer of vibrations from the hoisting ropes 42 to the car frame 11 or from the car frame 11 to the car 10. The load sensor arrangement measures the forces the forces acting between the hoisting ropes 42 and the car frame 11 or between the car 10 and the car frame 11.

FIG. 6 shows a side view of a second support arrangement of the car in an elevator.

The frame 11 of the car 10 is supported by the hoisting ropes 42. The hoisting ropes 42 pass over deflection sheaves 44, 45 supported on the lower end of the frame 11 of the car 10. The car 10 is supported on the lower horizontal bar 11B of the frame 11.

A combined elevator vibration isolation and load measurement element 400 may be positioned between the bottom of the car 10 and the lower horizontal support bar 11B of the frame 11.

The bottom of the car 10 may be supported via e.g. four combined elevator vibration isolation and load measurement elements 400 on the lower horizontal bar 11B of the frame 11. The combined elevator vibration isolation and load measurement elements 400 may be positioned in the corners of the bottom of the car 10.

The combined elevator vibration isolation and load measurement element 400 may be formed as a combination of a vibration isolation pad, an elastic material layer and an integrated load sensor arrangement.

The isolation pad eliminates at least to some extent the transfer of vibrations from the car frame 11 to the car 10. The load sensor arrangement measures the forces acting between the car 10 and the car frame 11.

FIG. 7 shows a side view of a first combined elevator vibration isolation and load measurement element.

The combined elevator vibration isolation and load measurement element may comprise a vibration isolation pad 50, an elastic material layer 110 and a load sensor arrangement 100.

The elastic material layer 110 may be planar having a first surface and a second opposite surface. The elastic material layer 110 may further be stretchable and electrically non-conducting. The first layer 110 may be formed of one single material or of several different materials.

The load sensor arrangement 100 may comprise at least two electrodes 121, 122 attached to the elastic material layer 110 so that the electrodes 121, 122 are positioned at a distance apart from each other. The electrodes 121, 122 may be attached to a first surface of the elastic material layer 110, said first surface being the bottom surface in the figure. The electrodes 121, 122 may be stretchable and electrically conducting.

The arrangement may further comprise a flexible foil 130. An electrically conductive wiring 141, 142 may pass between the flexible foil 130 and the electrodes 121, 122. The electrically conductive wiring 141, 142 may be attached from one surface to the electrodes 121, 122 and from an opposite surface to the flexible foil 130.

Each of the electrodes 121, 122 may be electrically connected to a specific part of an electrically conductive wiring 141, 142, said specific part of the electrically conductive wiring 141, 142 forming an electrical output of said electrode 121, 122.

The arrangement may further comprise a first electrically conductive layer 150 provided on the second free surface of the elastic material layer 110, said second surface being the upper surface in the figure.

The isolation vibration pad 50 in the combined elevator vibration isolation and load measurement element 300 may be provided on the first electrically conductive layer 150.

The combined elevator vibration isolation and load measurement element 400 may be positioned between the hoisting machinery 30 and the bed plate 37 in the motor bed 36.

The load sensor arrangement 100 in the figure may form a capacitive sensor, whereby the capacitance between each electrode 121, 122 and the first electrically conductive layer 150 may be measured. The distance between the electrodes 121, 122 and the first electrically conductive layer 150 varies in response to the force F1 acting on the vibration isolation pad 50. The force F1 acts through the vibration isolation pad 20 on the load sensor arrangement. The compression of the elastic material layer 110 corresponds to the load F1 acting on the vibration isolation pad 50. A greater load F1 means that the elastic material layer 110 becomes more compressed i.e. the distance between the electrodes 121, 122 and the first electrically conductive layer 150 is reduced and vice a versa.

The elastic material layer 110 may comprise at least one of polyurethane, polyethylene, poly(ethylene-vinyl acetate), polyvinyl chloride, polyborodimethylsiloxane, polystyrene, acrylonitrile-butadiene-styrene, styrene-butadienestyrene, ethylene propylene rubber, neoprene, cork, latex, natural rubber, silicone and thermoplastic gel.

The electrodes 121, 122 may comprise electrically conductive particles, such as flakes or nanoparticles, attached to each other in an electrically conductive manner. The electrical conductive particles may comprise at least one of carbon copper, silver and gold.

The first electrically conductive layer 150 may comprise at least one of electrically conductive material from conductive ink, electrically conductive fabric and electrically conductive polymer.

The wiring 141, 142 may be attached to the electrodes 121, 122 with electrically conductive adhesive, i.e. an adhesive comprising cured electrically conductive adhesive. Such adhesives may include isotropically conductive adhesives and anisotropically conductive adhesives.

The flexible foil 130 may comprise at least one of polyester, polyamide, polyethylene, naphthalate, and polyetheretherketone.

The elastic material layer 110 and the vibration isolation pad 50 may in an embodiment be of the same material.

FIG. 8 shows a side view of a second combined elevator vibration isolation and load measurement element.

The combined elevator vibration isolation and load measurement element 400 is positioned between the hoisting machinery 30 and the bed plate 37 of the motor bed 36. The combined elevator vibration isolation and load measurement element 400 may comprise a vibration isolation pad 50 and an elastic material layer 210 attached to a first surface of the vibration isolation pad 50.

The load sensor arrangement 200 may comprise electrical antennas 221, 222, 223 arranged at a distance apart from each other. The electrical antennas 221, 222, 223 may be integrated into a first surface of the vibration isolation pad 50. The electrical antennas 221, 222, 223 may be positioned flush with the first surface of the vibration isolation pad 50. This means that the electrical antennas 221, 222, 223 are also flush with a first surface of the elastic material layer 210. Said first surface of the elastic material layer 210 being attached to the first surface of the vibration isolation pad 50. The electrical antennas 221, 222, 223 are directed to send through the elastic material layer 210 towards a metal object, which may be bed plate 37 in a motor bed 36. The bed plate 37 may be on the opposite second surface of the elastic material layer 210 in relation to the electrical antennas 221, 222, 223.

The electrical antennas 221, 222, 223 may comprise an electronic oscillator consisting of an inductive coil, a capacitor for storing electrical charge, and an energy source to provide electrical excitation. The size of the inductive coil and the capacitor are matched to produce a self-sustaining sine wave oscillation at a fixed frequency. Electrical energy is fed into the circuit to initiate and sustain the oscillation. The oscillation produces an electromagnetic field in front of the sensor, because the coil is located right behind the "face" of the sensor.

When a piece of conductive metal enters the zone defined by the boundaries of the electromagnetic field, some of the energy of oscillation is transferred into the metal of the target. This transferred energy appears as tiny circulating electrical currents called eddy currents, which encounter electrical resistance as they try to circulate in the target. This creates a small power loss in the form of heat in the target. The power loss is not entirely replaced by the internal energy source of the sensor, so the amplitude of the oscillation of the sensor changes. This change can be measured with a measuring circuit.

The distance between the electrical antennas 221, 222, 223 and the bed plate 37 will affect the oscillation of the sensor.

The load sensor arrangement 200 may thus measure the distance between the electrical antennas 221, 222, 223 and the metal object 37. Changes in the distance between the electrical antennas 221, 222, 223 and the metal object 37 correspond to the compression of the elastic material layer 210 and the compression of the elastic material layer 210 corresponds to the load F1 acting on the vibration isolation pad 50.

FIG. 9 shows a side view of a third combined elevator vibration isolation and load measurement element.

The combined elevator vibration isolation and load measurement element 400 is positioned between the hoisting machinery 30 and the bed plate 37 of the motor bed 36. The combined elevator vibration isolation and load measurement element 400 comprises a vibration isolation pad 50 and an elastic material layer 310 attached to a first surface of the vibration isolation pad 50.

The elastic material layer 310 may be formed of a pressure mat 310 comprising pressure cells 321, 322, 323 within the pressure mat 310. The pressure cells 321, 322, 323 may comprise a fluid or a gas. Each pressure cell 321, 322, 323 may be connected via a piping to a pressure sensor. The pressure sensor measures the pressure in the fluid or gas in the pressure cell 321, 322, 323. The pressure cells 321, 322, 323 form the load pressure arrangement 300 in this embodiment.

The pressure in the pressure cell 321, 322, 323 corresponds to the load F1 acting on the vibration isolation pad 50.

The elevator shown in FIG. 2 could be modified so that the hoisting machinery 30 would be positioned in a machine room at the top of the shaft 20. The hoisting machinery 30 could in such case correspond to the hoisting machinery shown in FIG. 4. The fixing points A1, A2 of the ropes 42 could be at the top of the shaft 20 or in the machine room.

The combined elevator vibration isolation and load measurement element could also be used in connection with the fixing points A1, A2 of the ropes 42 in an elevator with a 2.1 suspension ratio. The arrangement could be similar to the arrangement shown in FIG. 5. The ropes 42 could be attached to a support bar 43, whereby the support bar 43 would be supported in the shaft 20 or in the machine room via combined elevator vibration isolation and load measurement elements to a support surface arranged in the shaft or in the machine room.

The combined elevator vibration isolation and load measurement element 400 is shown in the figures so that the vibration isolation pad 50 is positioned above the elastic layer 110, 210, 310. The situation could be reversed i.e. the vibration isolation pad 50 could be positioned below the elastic layer 110, 210, 310. The situation could also be such that the elastic layer 110, 210, 310 is positioned between two isolation pads 50.

The vibration isolation pad 50 separates or isolates the vibratory forces or motion of one object from another. There are two facets of vibration management i.e. isolation and damping. Isolation is the prevention of vibrations from entering a system. Damping is the absorption of the vibration energy that is entering the system and dissipating it by changing the kinetic energy of vibration into a different form of energy. The two forms of vibration management are different form each other, but often used in conjunction to achieve the desired performance. The transmissibility of the vibration isolation pad 50 as a function of the frequencies of the vibration should be such that the relevant vibration frequencies are absorbed effectively in the vibration isolation pad 50. The vibration isolation pad 50 should be sufficiently flexible and/or compressible in order to transmit as little as possible vibrational forces from the drive object. The vibration isolation pad 50 may be made e.g. from an elastomer composite or micro-cellular elastomer. Neoprene, rubber or synthetic foam pads can be used in the vibration isolation pad 50. Vibration isolation pads 50 marketed e.g. by BASF or TICO e.g. under the trade names Cellasto or Z/PA or S/PA may be used in the invention. The elastomer composite could be based on polychloroprene rubber enhanced with the inclusion of cork. The vibration isolation pad 50 could be made of a single material or of several materials. The vibration isolation pad 50 could be made of the same material as the elastic material layer 110, 210, 310 or of a different material. The vibration isolation pad 50 may also be elastic. This kind of vibration isolation pad 50 may be used in all embodiments of the invention.

The elastic material layer 110, 210, 310 has a first Young's modulus Y110 and a first yield strain ε110. The first yield stain ε110 may be at least 10 percent.

The thickness t110 of the elastic material layer 110, 210, 310 may be in the range of 1 to 8 mm, preferably in the range of 2 to 6 mm.

The flexible foil 130 has a second Young's modulus Y130 and a second yield strain ε130.

The thickness t130 of the flexible foil 130 may be less than 0.5 mm.

The isolation pad 50 has a third Young's modulus Y50 and a third yield strain ε50.

The thickness t50 of the isolation pad 50 may be in the range of 10 to 80 mm, preferably in the range of 20 to 70 mm.

The first Young's modulus Y110 may be smaller than the second Young's modulus Y130.

The materials mentioned in connection with the embodiment shown FIG. 7 may also be used in connection with the embodiments shown in FIGS. 8 and 9.

Young's modulus is a mechanical property that measures the stiffness of a solid material. It defines the relationship between stress (force per unit area) and strain (proportional deformation) in a material in the linear elasticity regime of a uniaxial deformation.

The yield point is the point on a stress-strain curve that indicates the limit of elastic behavior and the beginning of plastic behavior. Yield strength or yield stress is a material property defining the stress at which a material begins to deform plastically whereas yield point is the point where nonlinear (elastic+plastic) deformation begins. Prior to the yield point the material will deform elastically and will return to its original shape when the applied stress is removed. Once the yield point is passed, some fraction of the deformation will be permanent and non-reversible. Yield strain is a strain value corresponding to yield stress. The yield strain can be read from a material's stress-strain curve for yield point. The yield strain defines the material's elongation limit before plastic deformation occurs.

Vibrations may pass from the motor or from the motor bed or from the hoisting ropes to the building. A first possible route is from the machine room via the floor to the building. A second possible route is from the bed in the shaft to the walls of the shaft and further to the building. A third possible route is from the bed in the shaft to the guide rails and from the guide rails to the walls of the shaft and from the walls of the shaft to the building.

Vibrations may pass from the suspension of the hoisting ropes to the building. A first possible route is from the machine room via the floor to the building. A second possible route is from the bed in the shaft to the walls of the shaft and further to the building. A third possible route is from the bed in the shaft to the guide rails and from the guide rails to the walls of the shaft and from the walls of the shaft to the building.

Vibrations may pass from the hoisting ropes to the car. The route may be via the suspension of the traction sheaves in a 1:1 suspension ratio or via the suspension bar of the direction change sheaves.

Vibrations may further pass from the car frame to the car.

The use of the invention is not limited to the elevators disclosed in the figures. The invention can be used in any type of elevator e.g. an elevator comprising a machine room or lacking a machine room, an elevator comprising a counterweight or lacking a counterweight. The counterweight could be positioned on either side wall or on both side walls or on the back wall of the elevator shaft. The drive, the motor, the traction sheave, and the machine brake could be positioned in a machine room or somewhere in the elevator shaft. The car guide rails could be positioned on opposite side walls of the shaft or on a back wall of the shaft in a so called ruck-sack elevator.

It will be obvious to a person skilled in the art that, as the technology advances, the inventive concept can be implemented in various ways. The invention and its embodiments are not limited to the examples described above but may vary within the scope of the claims.

The invention claimed is:

1. A combined elevator vibration isolation and load measurement element comprising:

a vibration isolation pad with two opposite substantially planar surfaces in a first direction;

an elastic material layer having a first side permanently attached to a first of the two substantially planar surfaces of the vibration isolation pad; and a load sensor arrangement attached to a second side of the elastic material layer in the first direction and integrated into the combined elevator vibration isolation and load measurement element, whereby the load sensor arrangement is configured to measure a load acting on the combined elevator vibration isolation and load measurement element as a function of compression of the elastic material layer.

2. The combined elevator vibration isolation and load measurement element according to claim 1, wherein the elastic material layer is formed of a pressure mat comprising pressure cells within the pressure mat, whereby the load sensor arrangement measures the pressure in the pressure cells, said pressure being a function of the load acting on the vibration isolation pad.

3. The combined elevator vibration isolation and load measurement element according to claim 2, wherein the elastic material layer has a first Young's modulus and a first yield strain, the first yield strain being at least 10 percent, wherein the first yield strain is an elongation limit of the elastic material before plastic deformation occurs.

4. The combined elevator vibration isolation and load measurement element according to claim 1, wherein the load sensor arrangement comprises electrical antennas arranged at a distance apart from each other and integrated into a first surface of the vibration isolation pad, the electrical antennas being directed to send through the elastic material layer towards a metal object on the opposite surface of the elastic material layer, whereby the distance between the electrical antennas and the metal object can be measure inductively, said distance corresponding to the compression of the elastic material layer and thereby to the load acting on the vibration isolation pad may be measured.

5. The combined elevator vibration isolation and load measurement element according to claim 4, wherein the elastic material layer has a first Young's modulus and a first yield strain, the first yield strain being at least 10 percent, wherein the first yield strain is an elongation limit of the elastic material before plastic deformation occurs.

6. The combined elevator vibration isolation and load measurement element according to claim 1, wherein the load sensor arrangement comprises electrodes arranged at a distance apart from each other and attached to a first surface of the elastic material layer, a first electrical layer attached to a second opposite surface of the elastic material layer, whereby the distance between each electrode and the first electrical layer can be measured capacitively, said distance corresponding to the compression of the elastic material layer and thereby to the load acting on the vibration isolation pad.

7. The combined elevator vibration isolation and load measurement element according to claim 6, wherein the elastic material layer has a first Young's modulus and a first yield strain, the first yield strain being at least 10 percent, wherein the first yield strain is an elongation limit of the elastic material before plastic deformation occurs.

8. The combined elevator vibration isolation and load measurement element according to claim 1, wherein the elastic material layer has a first Young's modulus and a first yield strain, the first yield strain being at least 10 percent, and wherein the first yield strain is an elongation limit of the elastic material before plastic deformation occurs.

9. The combined elevator vibration isolation and load measurement element according to claim 1, wherein the thickness of the vibration isolation pad is in the range of 10 to 80 mm.

10. The combined elevator vibration isolation and load measurement element according to claim 1, wherein the thickness of the elastic material layer is in the range of 1 to 8 mm.

11. An elevator comprising:

a car;

a shaft;

a hoisting machinery with a traction sheave;

hoisting ropes;

a counterweight; and a controller, wherein the hoisting ropes pass over the traction sheave so that the car is suspended with the hoisting ropes on a first side of the traction sheave and the counterweight is suspended with the hoisting ropes on a second opposite side of the traction sheave, the car moving upwards and downwards between landings in the elevator shaft, the elevator being provided with the combined elevator vibration isolation and load measurement element according to claim 1.

12. The elevator according to claim 11, wherein the hoisting machinery is supported with at least one combined elevator vibration isolation and load measurement element on a machinery bed plate.

13. The elevator according to claim 11, wherein the hoisting ropes are attached to a support bar, said support bar being attached via at least one combined elevator vibration isolation and load measurement element to a frame of the car or to a support surface in the shaft or in a machine room.

14. The elevator according to claim 11, wherein the car is supported via at least one combined elevator vibration isolation and load measurement element on the car frame.

15. The combined elevator vibration isolation and load measurement element according to claim 1, wherein the thickness of the vibration isolation pad is in the range of 20 to 70 mm.

16. The combined elevator vibration isolation and load measurement element according to claim 1, wherein the thickness of the elastic material layer is in the range of 2 to 6 mm.

17. A combined elevator vibration isolation and load measurement element comprising:

a vibration isolation pad with two opposite substantially planar surfaces;

an elastic material layer permanently attached to a first of the two substantially planar surfaces of the vibration isolation pad; and a load sensor arrangement integrated into the combined elevator vibration isolation and load measurement element, whereby a load acting on the combined elevator vibration isolation and load measurement element can be measured with the load sensor arrangement as a function of the compression of the elastic material layer, wherein the load sensor arrangement comprises electrodes arranged at a distance apart from each other and attached to a first surface of the elastic material layer, a first electrical layer attached to a second opposite surface of the elastic material layer, whereby the distance between each electrode and the first electrical layer can be measured capacitively, said distance corresponding to the compression of the elastic material layer and thereby to the load acting on the vibration isolation pad, and wherein each of the electrodes is electrically connected to a specific part of an electrically conductive wiring, said specific part of the electrically conductive wiring forming an electrical output of said electrode, the electrically conductive wiring being further attached to an electrically insulating flexible foil.

18. The combined elevator vibration isolation and load measurement element according to claim 17, wherein the flexible foil has a second Young's modulus, the first Young's modulus being less than the second Young's modulus.

19. The combined elevator vibration isolation and load measurement element according to claim 17, wherein the elastic material layer has a first Young's modulus and a first yield strain, the first yield strain being at least 10 percent, wherein the first yield strain is an elongation limit of the elastic material before plastic deformation occurs.

20. A combined elevator vibration isolation and load measurement element comprising:

a vibration isolation pad with two opposite substantially planar surfaces;

an elastic material layer permanently attached to a first of the two substantially planar surfaces of the vibration isolation pad; and a load sensor arrangement integrated into the combined elevator vibration isolation and load measurement element, whereby a load acting on the combined elevator vibration isolation and load measurement element can be measured with the load sensor arrangement as a function of the compression of the elastic material layer, wherein the load sensor arrangement comprises electrodes arranged at a distance apart from each other and attached to a first surface of the elastic material layer, a first electrical layer attached to a second opposite surface of the elastic material layer, whereby the distance between each electrode and the first electrical layer can be measured capacitively, said distance corresponding to the compression of the elastic material layer and thereby to the load acting on the vibration isolation pad, and wherein a total effective cross-sectional area of the electrodes is at least 50% of the total cross-sectional area of the elastic material layer.

* * * * *